US011317183B2

(12) United States Patent
Shen et al.

(10) Patent No.: US 11,317,183 B2
(45) Date of Patent: Apr. 26, 2022

(54) SPEAKER WITH REPLACEABLE SOUND GUIDING ASSEMBLY

(71) Applicant: Wistron Corporation, New Taipei (TW)

(72) Inventors: Sheng-Hsing Shen, New Taipei (TW); Chih-Feng Yeh, New Taipei (TW)

(73) Assignee: Wistron Corporation, New Taipei (TW)

( * ) Notice: Subject to any disclaimer, the term of this patent is extended or adjusted under 35 U.S.C. 154(b) by 20 days.

(21) Appl. No.: 16/735,651

(22) Filed: Jan. 6, 2020

(65) Prior Publication Data

US 2020/0267461 A1 Aug. 20, 2020

Related U.S. Application Data

(60) Provisional application No. 62/807,240, filed on Feb. 19, 2019.

(30) Foreign Application Priority Data

Nov. 1, 2019 (TW) ..... 108139636

(51) Int. Cl.
*H04R 1/34* (2006.01)
*H04R 1/02* (2006.01)

(52) U.S. Cl.
CPC ..... *H04R 1/026* (2013.01); *H04R 2201/028* (2013.01); *H04R 2201/029* (2013.01)

(58) Field of Classification Search
CPC . H04R 1/34; H04R 1/345; H04R 1/32; H04R 1/323
See application file for complete search history.

(56) References Cited

U.S. PATENT DOCUMENTS 4,200,170 A * 4/1980 Williams, Jr. ..... H04R 1/345 181/144
4,496,021 A 1/1985 Berlant
4,620,317 A * 10/1986 Anderson ..... H04R 1/345 181/155
4,625,829 A * 12/1986 Sirois ..... G10K 11/28 181/141

(Continued)

FOREIGN PATENT DOCUMENTS

CN 1235688 11/1999
CN 202261729 5/2012

(Continued)

OTHER PUBLICATIONS

"Office Action of Taiwan Counterpart Application", dated Dec. 25, 2020, p. 1-p. 9.

(Continued)

*Primary Examiner* — Ryan Robinson
(74) *Attorney, Agent, or Firm* — JCIPRNET

(57) ABSTRACT

A speaker includes a casing, a speaker unit, and a sound guiding assembly. The casing has an opening end and has at least one first connecting portion at the opening end. The speaker unit is disposed in the casing. The sound guiding assembly has at least one second connecting portion. The second connecting portion structurally interferes with the first connecting portion, such that the sound guiding assembly is detachably assembled to the opening end of the casing.

16 Claims, 13 Drawing Sheets

(56) References Cited

U.S. PATENT DOCUMENTS

| | | | | |
|---|---|---|---|---|
| 4,907,671 | A * | 3/1990 | Wiley | H04R 1/345 181/155 |
| 4,984,653 | A | 1/1991 | Spors | |
| 5,173,942 | A * | 12/1992 | Hirose | H04R 1/345 181/155 |
| 5,306,880 | A * | 4/1994 | Coziar | H04R 1/345 181/149 |
| 5,446,792 | A * | 8/1995 | Sango | H04R 1/345 381/160 |
| 5,451,726 | A * | 9/1995 | Haugum | H04R 1/345 181/150 |
| 6,257,365 | B1 * | 7/2001 | Hulsebus, II | G10K 11/28 181/155 |
| 6,578,660 | B2 * | 6/2003 | Taylor | H04R 1/345 181/154 |
| 6,957,715 | B2 * | 10/2005 | Christiansen | H04R 1/345 181/198 |
| 8,265,320 | B2 * | 9/2012 | Datz | H04R 1/30 381/341 |
| 8,442,242 | B2 * | 5/2013 | Harwood | H04R 1/345 381/160 |
| 8,750,540 | B2 * | 6/2014 | Tan | H04R 1/403 381/182 |
| 9,774,935 | B2 * | 9/2017 | Matsumura | H04R 1/403 |
| 9,854,353 | B2 | 12/2017 | Wang | |
| 9,883,282 | B2 * | 1/2018 | Goksel | H04R 1/2896 |
| 10,129,636 | B2 * | 11/2018 | Kim | H04R 1/2803 |
| 10,187,713 | B2 * | 1/2019 | Miyatake | G08B 3/00 |
| 10,375,471 | B2 * | 8/2019 | Johnson | H04R 1/345 |
| 10,484,790 | B1 * | 11/2019 | Kim | H04R 1/025 |
| 10,643,599 | B2 * | 5/2020 | Sterling | H04R 1/20 |
| 10,667,044 | B2 * | 5/2020 | Pan | H04R 7/127 |
| 10,779,079 | B1 * | 9/2020 | Yeh | H04R 1/025 |
| 10,887,684 | B2 * | 1/2021 | Katz | H05K 7/2039 |
| 10,911,865 | B2 * | 2/2021 | Sullivan | H04R 1/2811 |
| 2004/0071298 | A1 * | 4/2004 | Geeng | H04R 1/345 381/89 |
| 2004/0131217 | A1 | 7/2004 | Opie et al. | |
| 2007/0269074 | A1 * | 11/2007 | Broadley | H04R 1/345 381/386 |
| 2017/0006376 | A1 * | 1/2017 | Tan | H04R 1/345 |
| 2017/0125007 | A1 * | 5/2017 | Iida | G10K 11/17857 |
| 2017/0332166 | A1 * | 11/2017 | Kikuchi | H04R 1/025 |
| 2020/0236462 | A1 * | 7/2020 | Kitagawa | H04R 7/12 |
| 2020/0296503 | A1 * | 9/2020 | Hsu | H04R 1/021 |
| 2020/0413176 | A1 * | 12/2020 | Little | H04R 9/022 |

FOREIGN PATENT DOCUMENTS

| | | |
|---|---|---|
| CN | 203086654 | 7/2013 |
| CN | 107343243 | 11/2017 |
| JP | S5215216 | 4/1977 |
| JP | 2008272128 | 11/2008 |
| JP | 2009213102 | 9/2009 |
| JP | 2017069888 | 4/2017 |
| TW | M499718 | 4/2015 |
| TW | I554119 | 10/2016 |
| TW | 201642669 | 12/2016 |

OTHER PUBLICATIONS

"Search Report of Europe Counterpart Application", dated Jul. 6, 2020, p. 1-p. 8.

"Office Action of China Counterpart Application", dated Oct. 29, 2020, p. 1-p. 8.

"Office Action of Japan Counterpart Application", dated Mar. 30, 2021, p. 1-p. 6.

* cited by examiner

SPEAKER WITH REPLACEABLE SOUND GUIDING ASSEMBLY

CROSS-REFERENCE TO RELATED APPLICATION

This application claims the priority benefit of U.S. provisional application Ser. No. 62/807,240, filed on Feb. 19, 2019 and Taiwan application serial no. 108139636, filed on Nov. 1, 2019. The entirety of the above-mentioned patent application is hereby incorporated by reference herein and made a part of this specification.

BACKGROUND OF THE INVENTION

1. Field of the Invention

The disclosure relates to a speaker, and in particular, to a speaker with a replaceable sound guiding assembly.

2. Description of Related Art

As speaker technologies develop, consumers impose increasingly high requirements on sound quality provided by a speaker. For good speaker efficiency, most speakers are equipped with a sound guiding structure (such as a sound wave reflection structure and a sound amplifying structure). In addition, a specific material is used to make the sound guiding structure, so that a speaker generates a sound with a specific and proper tone as required by consumers. However, the sound guiding structure is generally an irreplaceable structure in the speaker. Therefore, consumers cannot change a material of the sound guiding structure to change, according to preferences, a tone of a sound generated by the speaker.

SUMMARY OF THE INVENTION

The disclosure provides a speaker with a sound guiding assembly that may be replaced as required with one made of a different material.

The speaker of the disclosure includes a casing, a speaker unit, and a sound guiding assembly. The casing includes an opening end and at least one first connecting portion at the opening end. The speaker unit is disposed in the casing. The sound guiding assembly includes a second connecting portion. The second connecting portion structurally interferes with the first connecting portion such that the sound guiding assembly is detachably assembled to the opening end of the casing.

In an embodiment of the disclosure, the sound guiding assembly and another sound guiding assembly are respectively made of two of metal, porcelain, ceramic, wood, plastic, and glass.

In an embodiment of the disclosure, the sound guiding assembly includes a reflecting surface facing the speaker unit.

In an embodiment of the disclosure, the speaker unit is adapted to transmit a sound wave to the reflecting surface in a first direction, and the reflecting surface is inclined toward the first direction to be adapted to reflect the sound wave such that the sound wave is transmitted in a second direction.

In an embodiment of the disclosure, the casing is a cylindrical casing, the first direction being an axial direction of the cylindrical casing, and the second direction being a radial direction of the cylindrical casing.

In an embodiment of the disclosure, the reflecting surface includes at least one of a plane, a conical surface, a pyramidal surface, an elliptical surface, a paraboloid, and a hyperboloid.

In an embodiment of the disclosure, the reflecting surface is hidden in an inside of the speaker.

In an embodiment of the disclosure, the sound guiding assembly includes a plurality of sound amplifiers arranged at an interval to form an sound amplifying channel between any two adjacent ones of the sound amplifiers, each of the sound amplifying channels including an inlet and an outlet opposite to each other, the outlet including an inner diameter greater than that of the inlet, and a sound wave from the speaker unit being adapted to enter the sound amplifying channel through the inlet and transmitted to an outside of the speaker through the outlet.

In an embodiment of the disclosure, each sound amplifier includes at least one of a paraboloid, a tapered surface, an exponential surface, and a hyperboloid.

In an embodiment of the disclosure, the sound amplifiers are hidden in an inside of the speaker.

In an embodiment of the disclosure, the sound amplifiers are radially arranged.

In an embodiment of the disclosure, the sound guiding assembly includes a bottom wall, the sound amplifiers being carried on the bottom wall.

In an embodiment of the disclosure, the bottom wall is located between the speaker unit and the sound amplifiers, and the bottom wall includes an opening.

In an embodiment of the disclosure, the sound amplifiers surround the opening.

In an embodiment of the disclosure, the sound guiding assembly includes a frame and a sound guiding assembly body, the at least one second connecting portion being connected to the frame, and the frame limiting the sound guiding assembly body within the casing.

In an embodiment of the disclosure, the sound guiding assembly body and the frame are integrally formed.

In an embodiment of the disclosure, the sound guiding assembly body is combined with the frame through gluing, in-mold forming, or welding.

In an embodiment of the disclosure, the second connecting portion includes at least one screwing member, and the first connecting portion includes at least one screw hole, the frame being screwed to the screw hole using the screwing member.

In an embodiment of the disclosure, the second connecting portion includes at least one elastic arm, an end of the at least one elastic arm including an engaging slot, and the first connecting portion includes at least one engaging block adapted to be engaged with the engaging slot through elastic deformation of the at least one elastic arm.

In an embodiment of the disclosure, the second connecting portion includes at least one engaging slot, and the first connecting portion includes at least one engaging block adapted to be moved into the at least one engaging slot with rotation of the frame relative to the casing.

DESCRIPTION OF THE EMBODIMENTS

Figure 1:
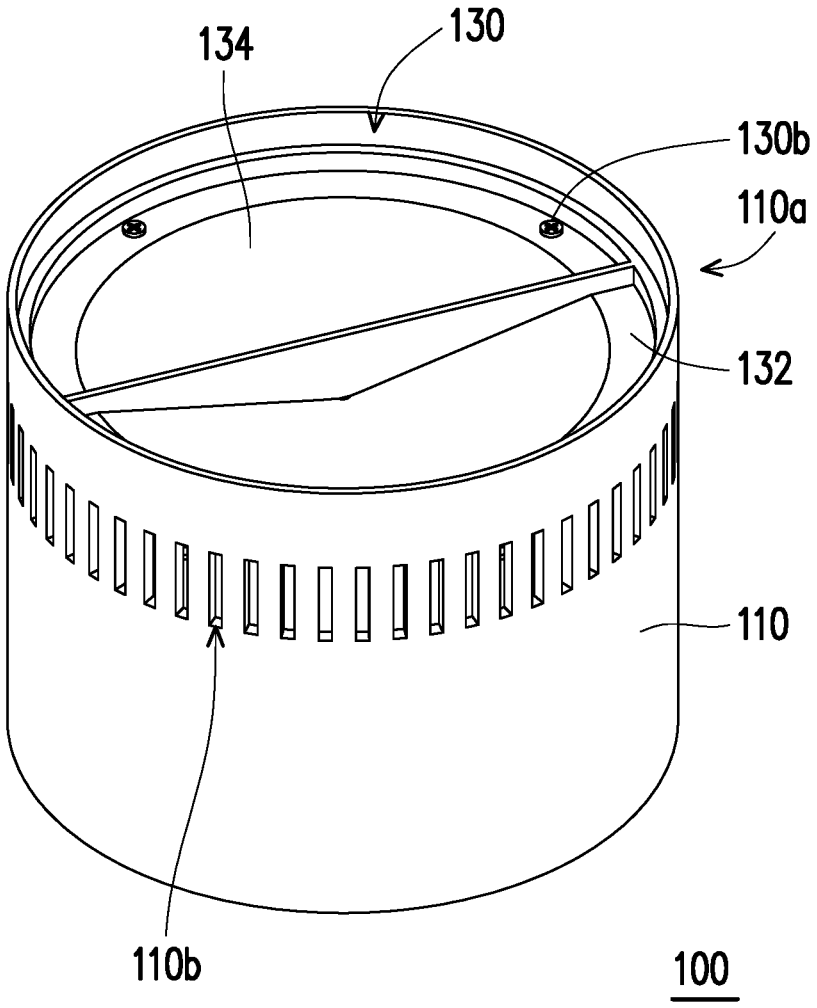
FIG. 1 is a three-dimensional view of a speaker according to an embodiment of the disclosure.
Figure 2:
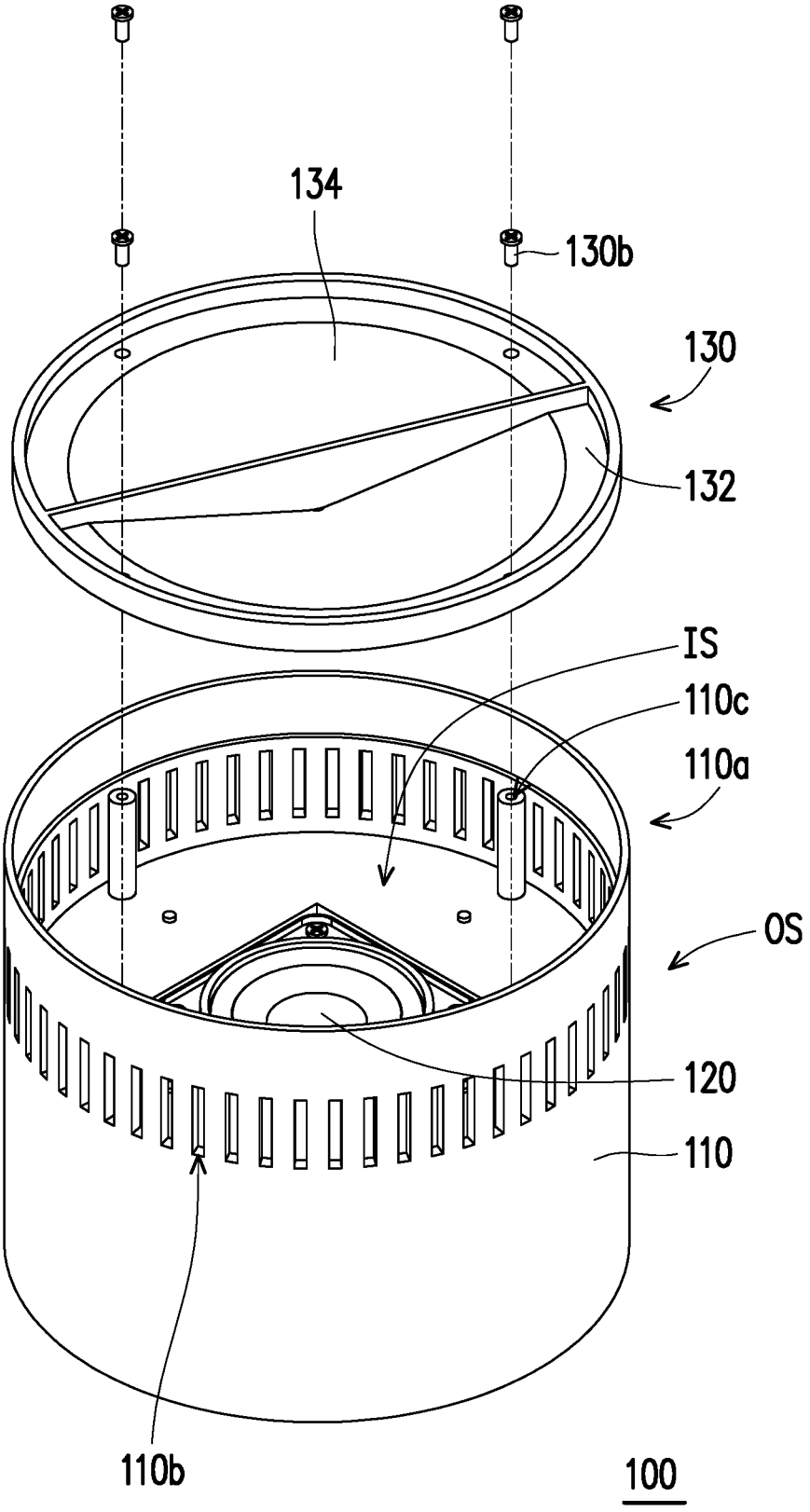
FIG. 2 is an exploded view of the speaker in FIG. 1.
Figure 3:
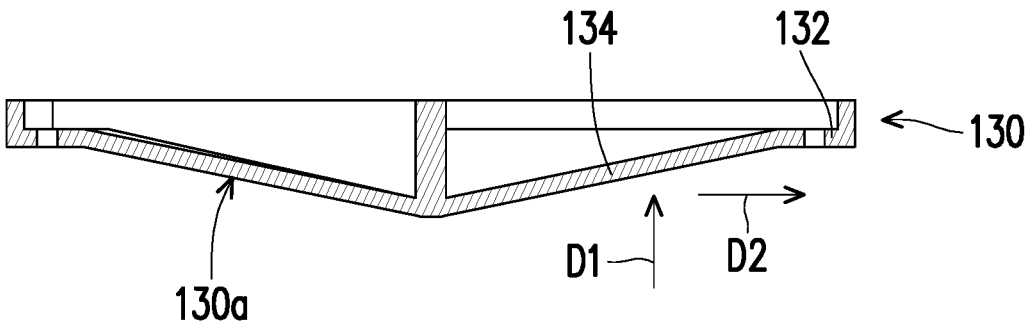
FIG. 3 is a cross-sectional view of a sound guiding assembly in FIG. 2.

FIG. 1 is a three-dimensional view of a speaker according to an embodiment of the disclosure. FIG. 2 is an exploded view of the speaker in FIG. 1. FIG. 3 is a cross-sectional view of a sound guiding assembly in FIG. 2. Referring to FIG. 1 to FIG. 3, a speaker 100 in the present embodiment includes a casing 110, a speaker unit 120, and a sound guiding assembly 130. The casing 110 has an opening end 110*a* and a plurality of first connecting portions 110*c* at the opening end 110*a*. The casing 110 is, for example, a cylindrical casing, and the speaker unit 120 is disposed in the casing 110 and adapted to generate a sound wave according to an audio signal. The speaker unit 120 is, for example, a moving-coil speaker unit, a piezoelectric speaker unit, an electrostatic speaker unit, or other types of speaker units. No limitation is imposed on this in the disclosure.

The sound guiding assembly 130 has a plurality of second connecting portions 130*b*. Each of the second connecting portions 130*b* structurally interferes with a corresponding first connecting portion 110*c*, such that the sound guiding assembly 130 is detachably assembled on the opening end 110*a* of the casing 110. In addition, the sound guiding assembly 130 has a reflecting surface 130*a* (shown in FIG. 3) facing the speaker unit 120. The speaker unit 120 is adapted to transmit a sound wave to the reflecting surface 130*a* in a first direction D1 (for example, an axial direction of the cylindrical casing shown in FIG. 3), and the reflecting surface 130*a* is inclined toward the first direction D1 to be adapted to reflect the sound wave such that the sound wave is transmitted in a second direction D2 (for example, a radial direction of the cylindrical casing shown in FIG. 3) to an outside OS of the speaker 100 through a sound outlet 110*b* of the casing 110. In the present embodiment, the reflecting surface 130*a* may include at least one of a plane, a conical surface, a pyramidal surface, an elliptical surface, a paraboloid, and a hyperboloid as required. No limitation is imposed on this in the disclosure.

The sound guiding assembly 130 is detachable as described above, so that it is convenient for a user to replace the existing sound guiding assembly 130 with a sound guiding assembly made of a different material. In this way, the speaker 100 can generate a sound of a different tone using the sound guiding assembly made of a different material. For example, the sound guiding assembly 130 and the another sound guiding assembly are respectively made of, for example, two of metal, porcelain, ceramic, wood, plastic, and glass, but the disclosure is not limited thereto. In addition, the reflecting surface 130*a* in the present embodiment is hidden in an inside IS of the speaker 100 without affecting an appearance of the speaker 100.

Figure 4:
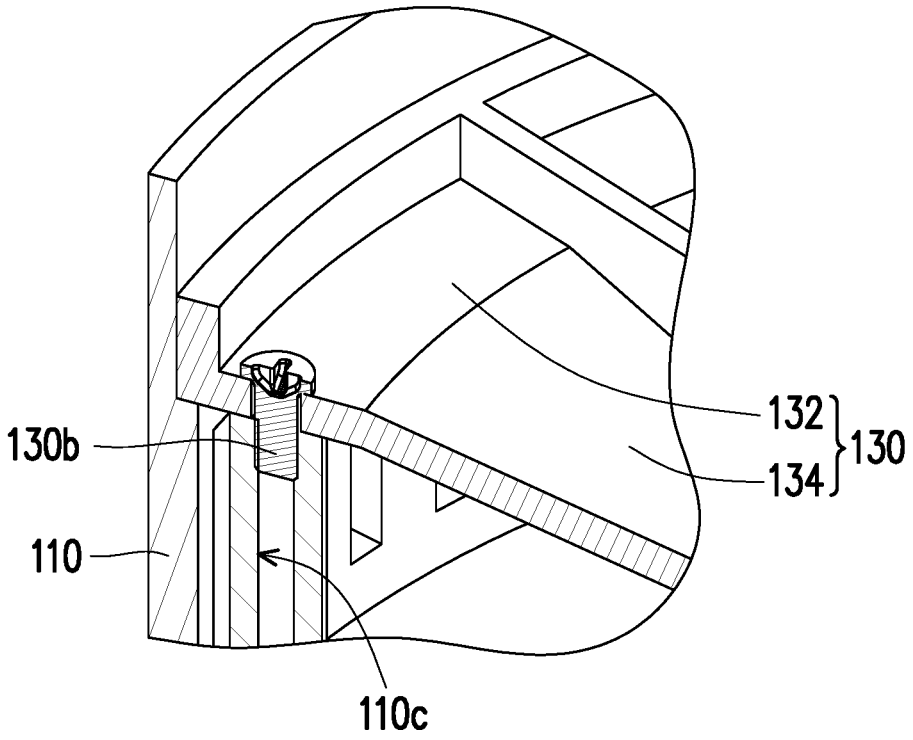
FIG. 4 is a partial three-dimensional view of the speaker in FIG. 1.

In the present embodiment, the sound guiding assembly 130 includes a frame 132 and a sound guiding assembly body 134. The frame 132 is, for example, annular, and the second connecting portion 130*b* is connected to the frame 132, such that the frame 132 is detachably assembled on the casing 110. In addition, the sound guiding assembly body 134 is, for example, integrally connected to the frame 132 to be limited within the casing 110. FIG. 4 is a partial three-dimensional view of the speaker in FIG. 1. Referring to FIG. 2 and FIG. 4, each of the second connecting portions 130*b* in the present embodiment is, for example, a screwing member, and each of the first connecting portions 110 *c* is, for example, a screw hole. The frame 132 is screwed to a plurality of screw holes of the casing 110 using the screwing members, such that the sound guiding member 130 is detachable as described above.

A manner in which the sound guiding assembly 130 is assembled to the casing 110 is not limited in the disclosure, which is exemplified below using the following drawings.

Figure 5:
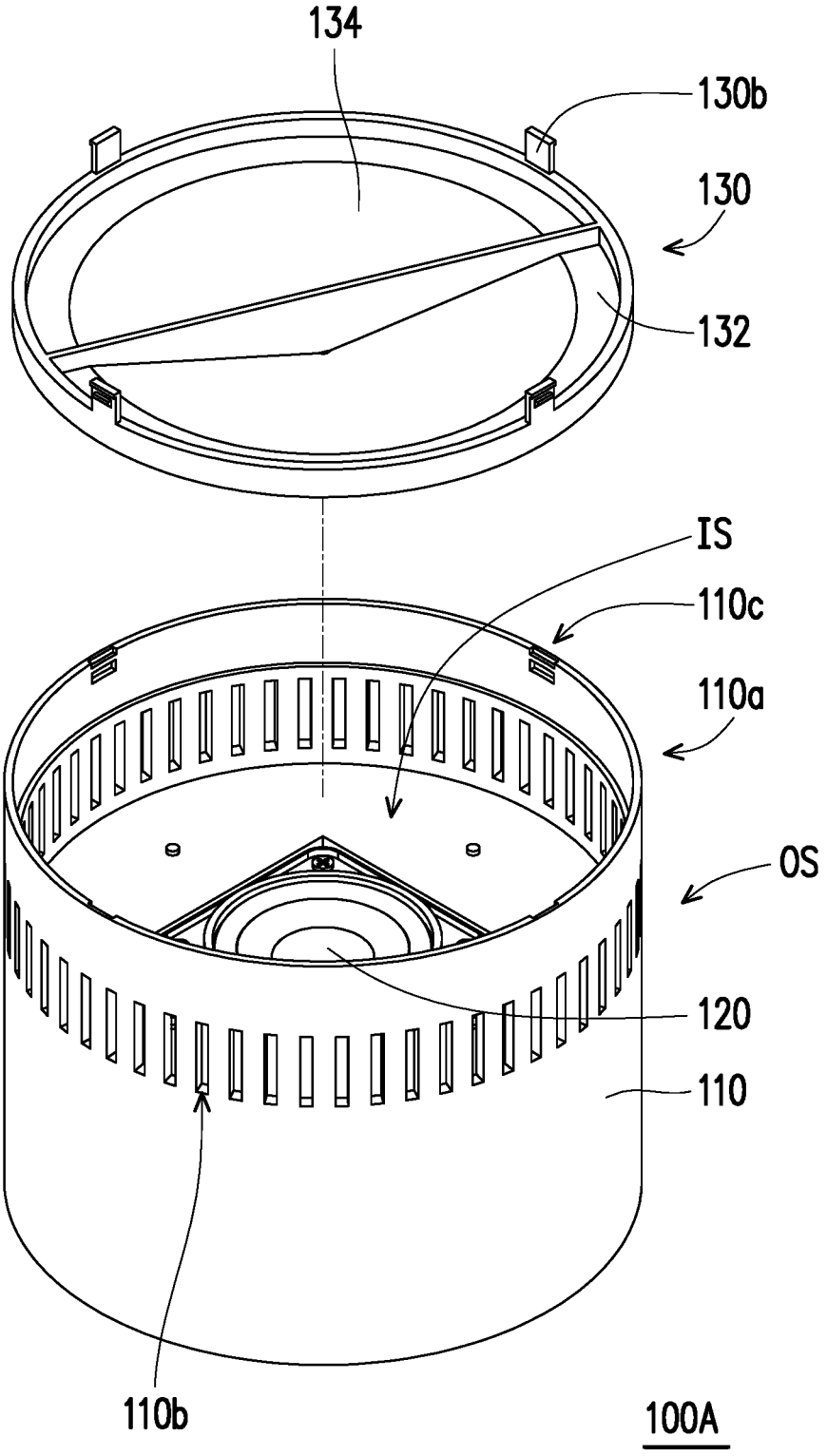
FIG. 5 is an exploded view of a speaker according to another embodiment of the disclosure.
Figure 6:
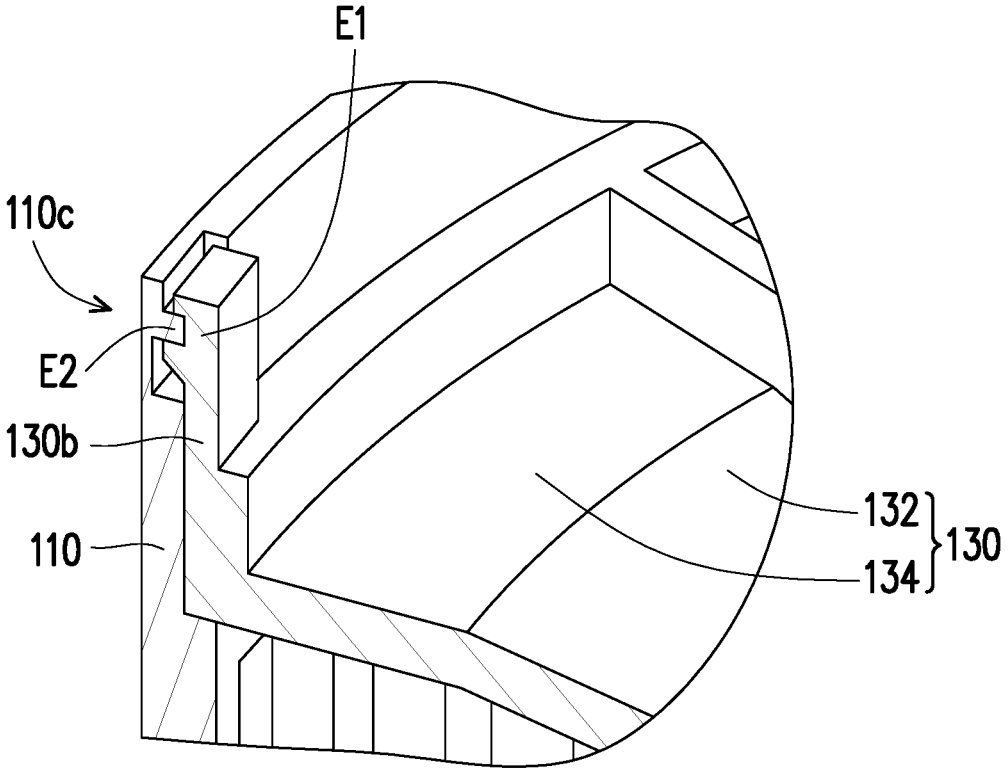
FIG. 6 is a partial three-dimensional view of the speaker in FIG. 5.

FIG. 5 is an exploded view of a speaker according to another embodiment of the disclosure. FIG. 6 is a partial three-dimensional view of the speaker in FIG. 5. A difference between a speaker 100A shown in FIG. 5 and the speaker 100 shown in FIG. 2 lies in that, unlike to that in FIG. 2, a frame 132 in FIG. 5 is not screwed to the casing 110 using the screwing member. Each of the second connecting portions 130*b* in FIG. 5 is an elastic arm, an end of each elastic arm having an engaging slot E1 shown in FIG. 6, and each of the first connecting portions 110*c* includes an engaging block E2. During assembling, as the sound guiding assembly 130 moves down toward the casing 110, when the second connecting portion 130*b* is in contact with the first connecting portion 110*c*, the elastic arm (the second connecting portion 130*b*) is elastically deformed by mutual abutment of the first connecting portion 110*c* and the second connecting portion 130*b*, such that the engaging block E2 may be smoothly engaged with the engaging slot E1 through elastic deformation of the elastic arm (the second connecting portion 130*b*), which is shown in FIG. 6. In addition, in other embodiments, the sound guiding assembly 130 may be assembled to the casing 110 using the screwing member in FIG. 2 and FIG. 4 and the elastic arm, the engaging slot E1, and the engaging block E2 in FIG. 5 and FIG. 6.

Figure 7:
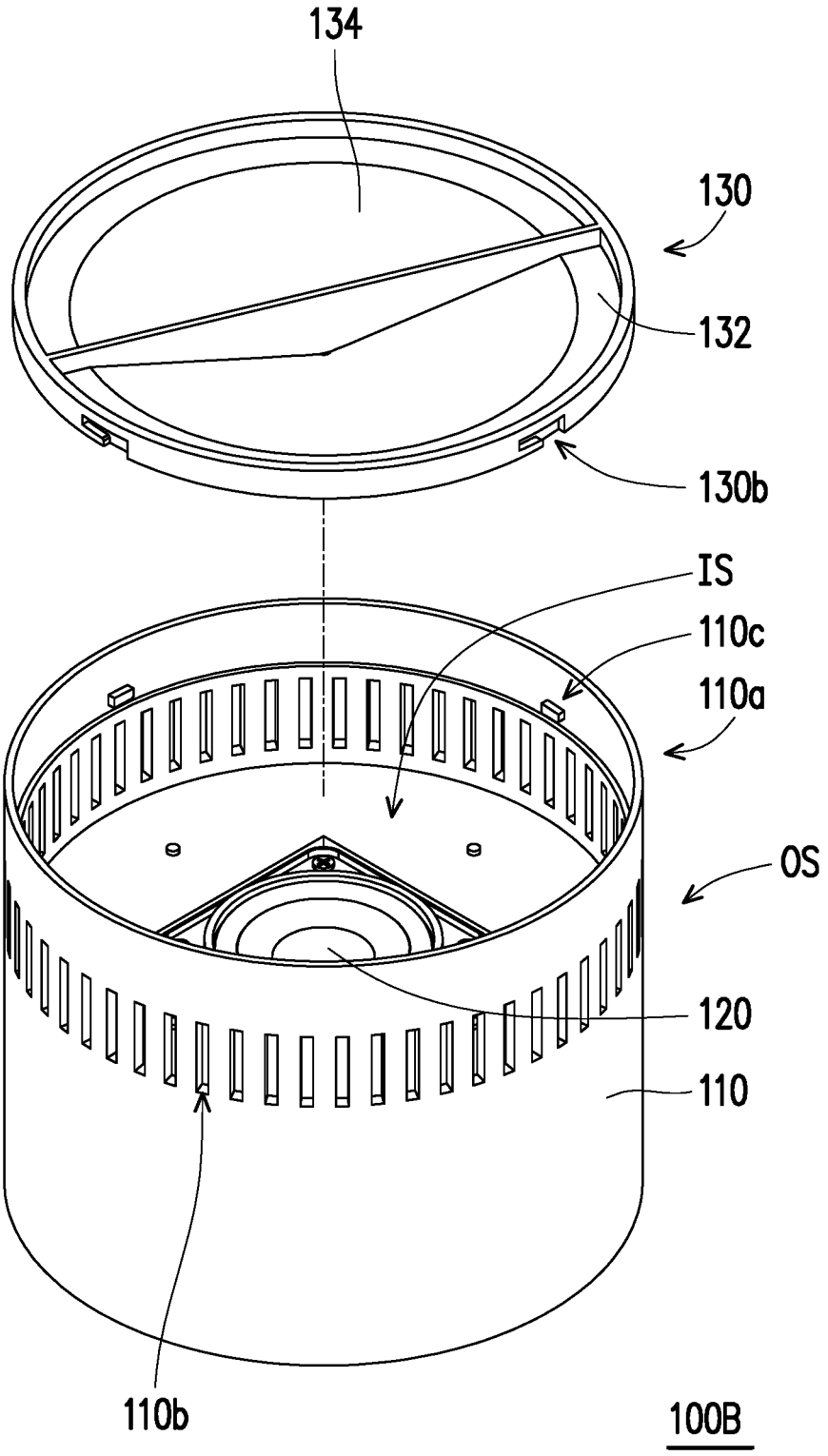
FIG. 7 is an exploded view of a speaker according to another embodiment of the disclosure.
Figure 8:
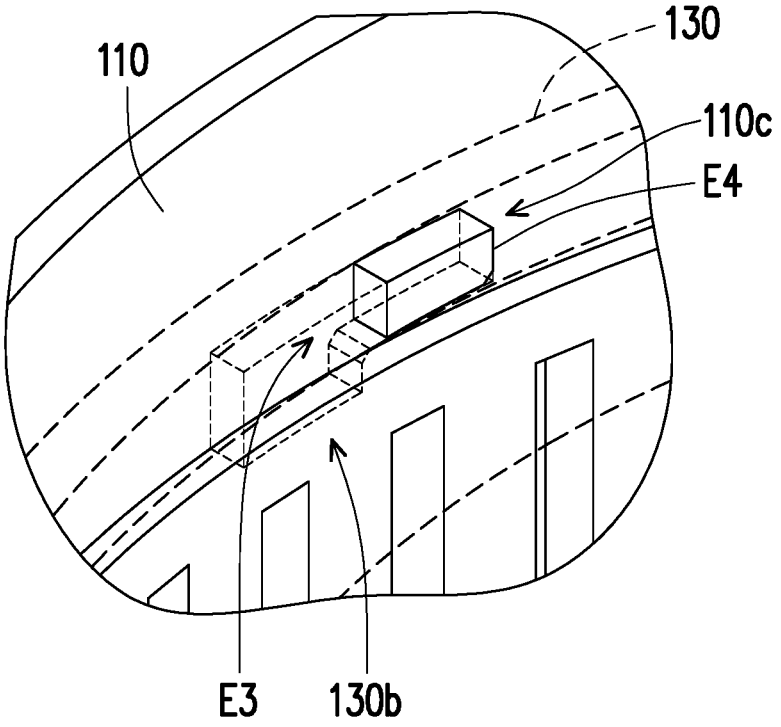
FIG. 8 is a partial three-dimensional view of the speaker in FIG. 7.

FIG. 7 is an exploded view of a speaker according to another embodiment of the disclosure. FIG. 8 is a partial three-dimensional view of the speaker in FIG. 7. A difference between a speaker 100B shown in FIG. 7 and the speaker 100 shown in FIG. 2 lies in that, unlike to that in FIG. 2, a frame 132 in FIG. 7 is not screwed to the casing 110 using the screwing member 140. Each of the second connecting portions 130*b* in FIG. 7 includes an engaging slot E3, and each of the first connecting portions 110*c* includes an engaging block E4. The engaging block E4 is adapted to be moved into the engaging slot E3 as the frame 132 rotates relative to the casing 110, which is shown in FIG. 8. In addition, in other embodiments, the sound guiding assembly 130 may be assembled to the casing 110 using the screwing member in FIG. 2 and FIG. 4 and the engaging slot E3 and the engaging block E4 shown in FIG. 7 and FIG. 8, or may be assembled to the casing 110 using the elastic arm, the engaging slot E1, and the engaging block E2 in FIG. 5 and FIG. 6 and the engaging slot E3 and the engaging block E4 shown in FIG. 7 and FIG. 8.

A manner in which the frame 132 is connected to the sound guiding assembly body 134 is not limited in the disclosure, which is exemplified below using the following drawings.

Figure 9:
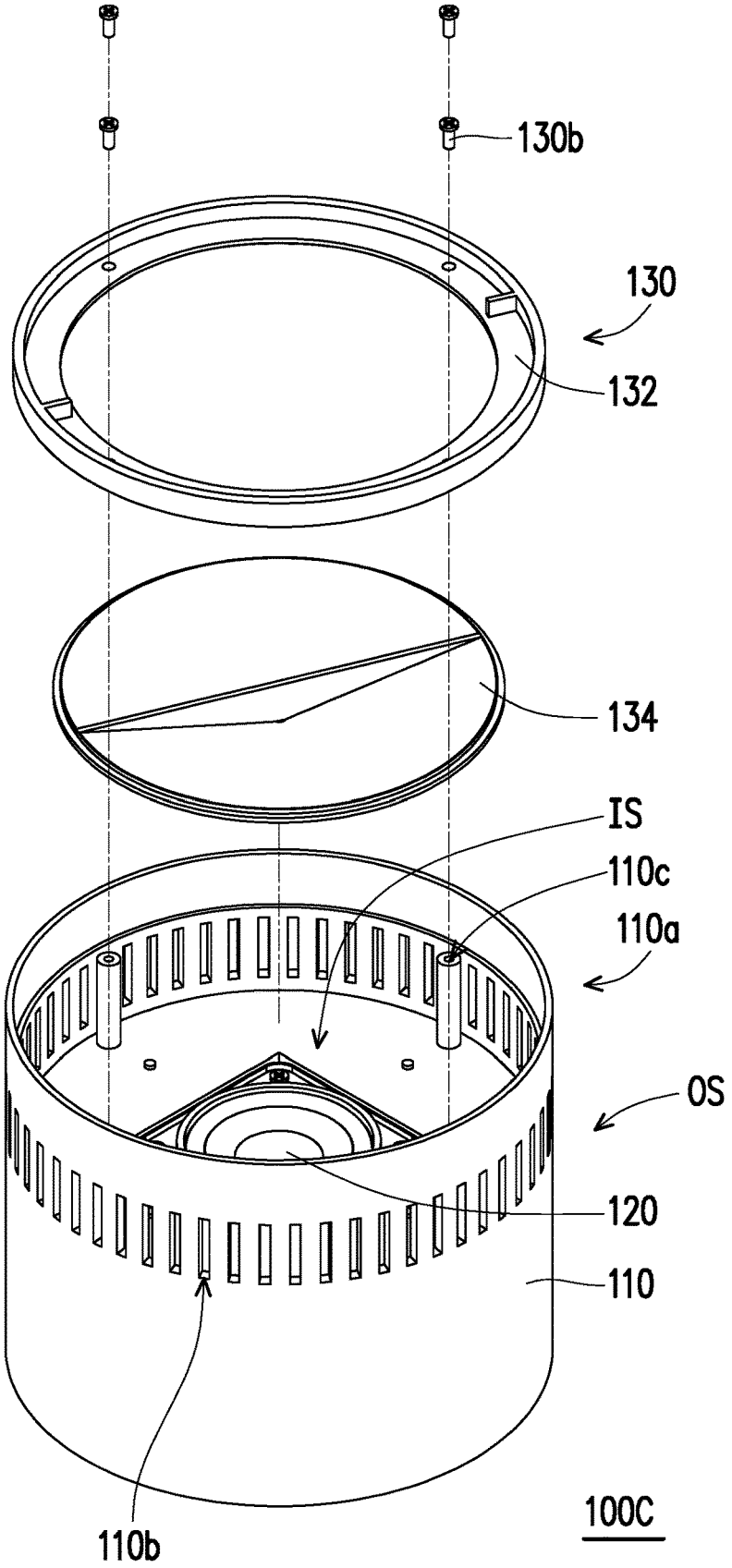
FIG. 9 is an exploded view of a speaker according to another embodiment of the disclosure.

FIG. 9 is an exploded view of a speaker according to another embodiment of the disclosure. A difference between a speaker 100C shown in FIG. 9 and the speaker 100 shown in FIG. 2 lies in that a frame 132 in FIG. 9 is not integrally formed with the sound guiding assembly body 134, and the sound guiding assembly body 134 is combined with the frame 132 through gluing, in-mold forming, welding, or the like. In addition, the sound guiding assembly body 134 may also be combined with the frame 132 through screwing, snap-fit, or the like. No limitation is imposed on this in the disclosure. Moreover, in addition to being screwed to the casing 110 using the screwing member, the sound guiding assembly 130 in FIG. 9 may also be combined with the casing 110 using the elastic arm, the engaging slot E1, and the engaging block E2 shown in FIG. 5 and FIG. 6, or may be combined with the casing 110 using the engaging slot E3 and the engaging block E4 shown in FIG. 7 and FIG. 8. Furthermore, in other embodiments, the sound guiding assembly 130 in FIG. 9 may be assembled to the casing 110 using the screwing member in FIG. 2 and FIG. 4 and the elastic arm, the engaging slot E1, and the engaging block E2 in FIG. 5 and FIG. 6, or may be assembled to the casing 110 using the screwing member in FIG. 2 and FIG. 4 and the engaging slot E3 and the engaging block E4 shown in FIG. 7 and FIG. 8, or may be assembled to the casing 110 using the elastic arm, the engaging slot E1, and the engaging block E2 in FIG. 5 and FIG. 6 and the engaging slot E3 and the engaging block E4 shown in FIG. 7 and FIG. 8.

In other implementations, the sound guiding assembly 130 may further include a sound amplifying structure, which is exemplified below using the following drawings.

Figure 10:
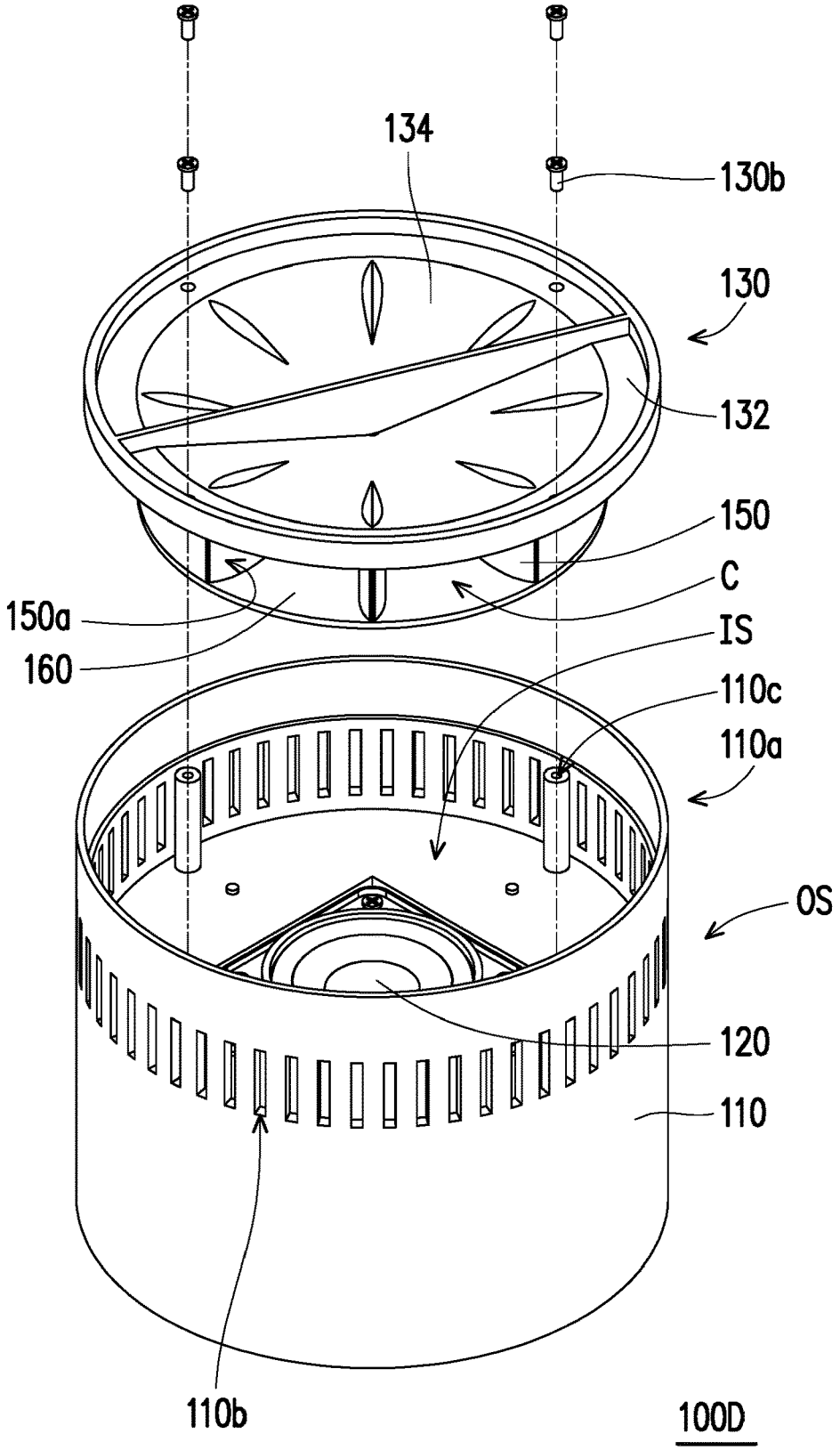
FIG. 10 is an exploded view of a speaker according to another embodiment of the disclosure.
Figure 11:
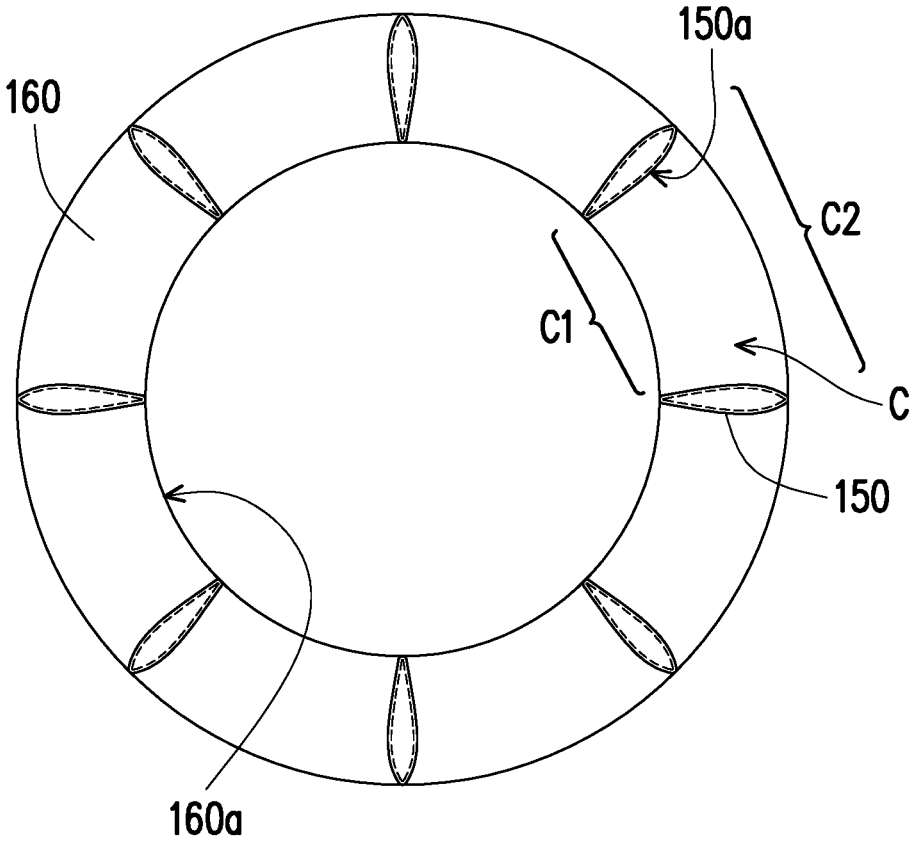
FIG. 11 is a top view of a portion of the speaker in FIG. 10.

FIG. 10 is an exploded view of a speaker according to another embodiment of the disclosure. FIG. 11 is a top view of a portion of the speaker in FIG. 10. A difference between a speaker 100D shown in FIG. 10 and the speaker 100 shown in FIG. 2 lies in that the sound guiding assembly 130 in FIG. 10 further includes a plurality of sound amplifiers 150 and a bottom wall 160. The sound amplifiers 150 are carried on the bottom wall 160 and are radially arranged at an interval to form a sound amplifying channel C between any two adjacent ones of the sound amplifiers 150. The bottom wall 160 has an opening 160*a* (shown in FIG. 11), and the sound amplifiers 150 surround the opening 160*a*. Each of the sound amplifying channels C has an inlet C1 (shown in FIG. 11) and an outlet C2 (shown in FIG. 11) opposite to each other. A sound wave from the speaker unit 120 is adapted to pass through the opening 160*a*, enter the sound amplification channel C through the inlet C1, and be transmitted to an outside OS of the speaker 100 through the outlet C2. As shown in FIG. 11, the outlet C2 has an inner diameter larger than that of the inlet C1 to amplify the sound wave. In the present embodiment, as shown in FIG. 11, each of the sound amplifiers 150 may be hollow or solid, and a surface 150*a* thereof may be designed to be a paraboloid, a tapered surface, an exponential surface or a hyperboloid according to a requirement on sound wave transmission efficiency. The sound amplifiers 150 may be connected to other structures of the sound guiding assembly 130 integrally or in a suitable manner such as through gluing. In addition, the sound amplifiers 150 in the present embodiment are hidden in an inside IS of the speaker 100D without affecting an appearance of the speaker 100D.

Figure 12:
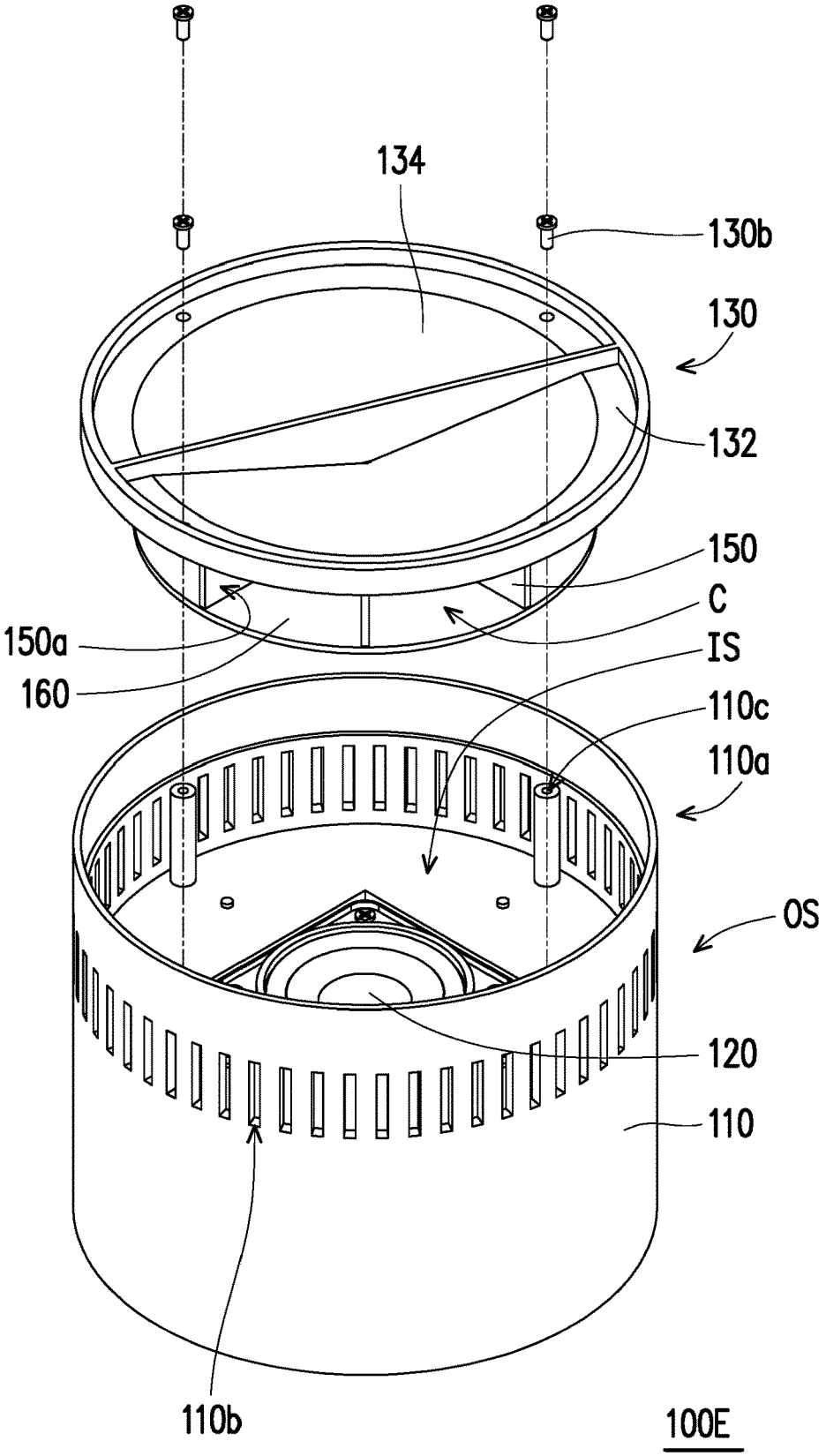
FIG. 12 is an exploded view of a speaker according to another embodiment of the disclosure.
Figure 13:
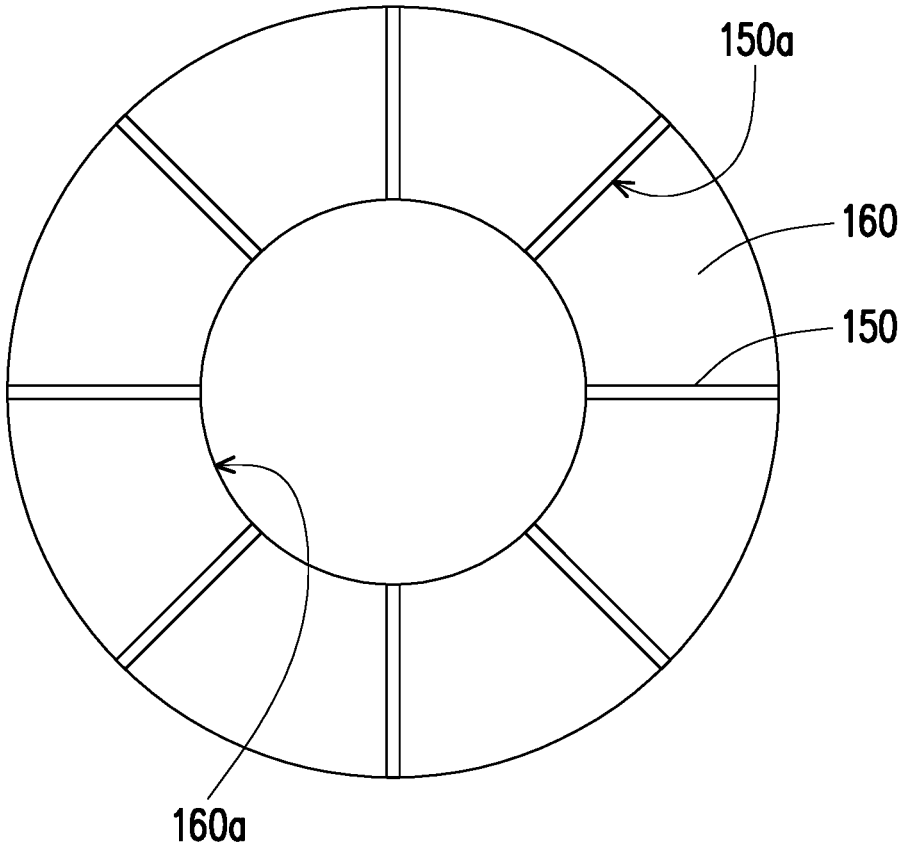
FIG. 13 is a top view of a portion of the speaker in FIG. 12.
Figure 14:
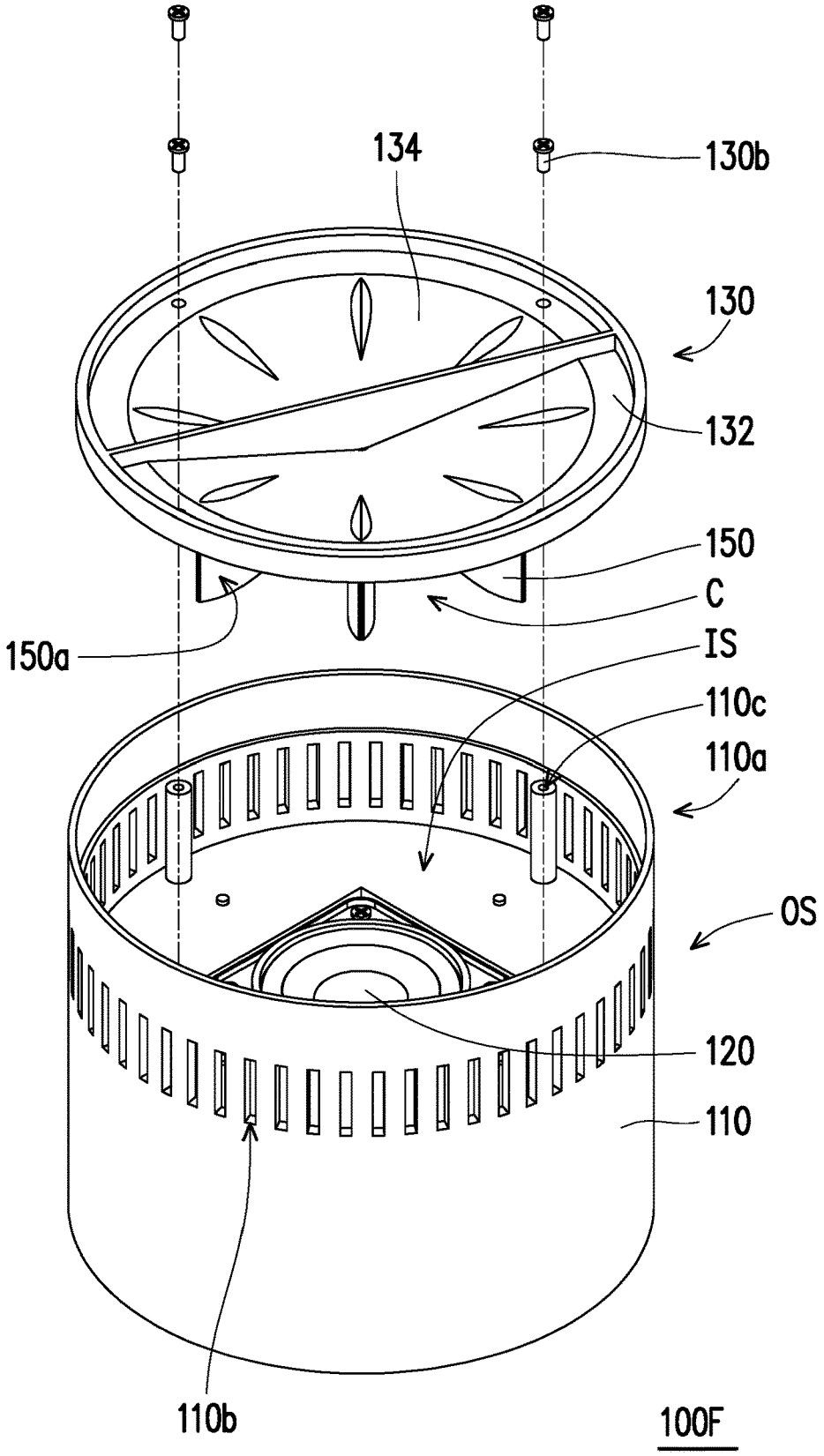
FIG. 14 is an exploded view of a speaker according to another embodiment of the disclosure.

FIG. 12 is an exploded view of a speaker according to another embodiment of the disclosure. FIG. 13 is a top view of a portion of the speaker in FIG. 12. A difference between a speaker 100E shown in FIG. 12 and the speaker 100D shown in FIG. 10 lies in that each of the sound amplifiers 150 in FIG. 12 is linear such that a surface 150*a* thereof is flat. FIG. 14 is an exploded view of a speaker according to another embodiment of the disclosure. A difference between a speaker 100F shown in FIG. 14 and the speaker 100D shown in FIG. 10 lies in that the sound guiding assembly 130 in FIG. 14 does not include the bottom wall 160 in FIG. 10. It should be noted that the sound amplifier 150 shown in FIG. 10 to FIG. 14 may be applied to any of the foregoing embodiments, and no limitation is imposed on this in the disclosure.

In summary, according to the speaker of the disclosure, the sound guiding assembly is detachable, so that it is convenient for a user to replace the existing sound guiding assembly with a sound guiding assembly made of a different material. In this way, the speaker can generate a sound of a different tone using the sound guiding assembly made of a different material. In addition, the reflecting surface and the sound amplifier of the sound guiding assembly may be designed to be hidden inside the speaker, so that the speaker has a favourable appearance.

What is claimed is:

1. A speaker, comprising:

a casing comprising an opening end and at least one first connecting portion at the opening end;

a speaker unit disposed in the casing; and a sound guiding assembly comprising at least one second connecting portion and a plurality of sound amplifiers arranged at an interval to form a sound amplifying channel between any two adjacent ones of the sound amplifiers, wherein the at least one second connecting portion structurally interferes with the at least one first connecting portion such that the sound guiding assembly is detachably assembled to the opening end of the casing, wherein the sound guiding assembly comprises a bottom wall, and the sound amplifiers are carried on the bottom wall, and the bottom wall is located between the speaker unit and the sound amplifiers, wherein the sound guiding assembly comprises a reflecting surface facing the speaker unit, the speaker unit is adapted to transmit a sound wave to the reflecting surface in a first direction, and the reflecting surface is inclined toward the first direction and is adapted to reflect the sound wave such that the sound wave is transmitted in a second direction, wherein the casing is a cylindrical casing, the first direction is an axial direction of the cylindrical casing, and the second direction is a radial direction of the cylindrical casing.

2. The speaker according to claim 1, wherein the sound guiding assembly is made of one of metal, porcelain, ceramic, wood, plastic, and glass.

3. The speaker according to claim 1, wherein the reflecting surface comprises at least one of a plane, a conical surface, a pyramidal surface, an elliptical surface, a paraboloid, and a hyperboloid.

4. The speaker according to claim 1, wherein the reflecting surface is hidden in an inside of the speaker.

5. A speaker, comprising:

a casing comprising an opening end and at least one first connecting portion at the opening end;

a speaker unit disposed in the casing; and a sound guiding assembly comprising at least one second connecting portion and a plurality of sound amplifiers arranged at an interval to form a sound amplifying channel between any two adjacent ones of the sound amplifiers, wherein the at least one second connecting portion structurally interferes with the at least one first connecting portion such that the sound guiding assembly is detachably assembled to the opening end of the casing, wherein the sound guiding assembly comprises a bottom wall, and the sound amplifiers are carried on the bottom wall, and the bottom wall is located between the speaker unit and the sound amplifiers, wherein each of the sound amplifying channels comprises an inlet and an outlet opposite to each other, the outlet has an inner diameter greater than an inner diameter of the inlet, and a sound wave from the speaker unit is adapted to enter the sound amplifying channel through the inlet and is transmitted to an outside of the speaker through the outlet.

6. The speaker according to claim 5, wherein each of the sound amplifiers comprises at least one of a paraboloid, a tapered surface, an exponential surface, and a hyperboloid.

7. The speaker according to claim 5, wherein the sound amplifiers are hidden in an inside of the speaker.

8. The speaker according to claim 5, wherein the sound amplifiers are radially arranged.

9. The speaker according to claim 1, wherein the bottom wall comprises an opening.

10. The speaker according to claim 9, wherein the sound amplifiers surround the opening.

11. A speaker, comprising:

a casing comprising an opening end and at least one first connecting portion at the opening end;

a speaker unit disposed in the casing; and a sound guiding assembly comprising at least one second connecting portion and a plurality of sound amplifiers arranged at an interval to form a sound amplifying channel between any two adjacent ones of the sound amplifiers, wherein the at least one second connecting portion structurally interferes with the at least one first connecting portion such that the sound guiding assembly is detachably assembled to the opening end of the casing, wherein the sound guiding assembly comprises a bottom wall, and the sound amplifiers are carried on the bottom wall, and the bottom wall is located between the speaker unit and the sound amplifiers, wherein the sound guiding assembly comprises a frame and a sound guiding assembly body, the at least one second connecting portion is connected to the frame, and the frame limits the sound guiding assembly body within the casing.

12. The speaker according to claim 11, wherein the sound guiding assembly body and the frame are integrally formed.

13. The speaker according to claim 11, wherein the sound guiding assembly: body is combined with the frame through gluing, in-mold forming, or welding.

14. The speaker according to claim 11, wherein the at least one second connecting portion comprises at least one screwing member, the at least one first connecting portion comprises at least one screw hole, and the frame is screwed to the screw hole using the screwing member.

15. The speaker according to claim 11, wherein the at least one second, connecting portion comprises at least one elastic arm, an end of the at least one elastic arm comprises, an engaging slot, and the at least one first connecting portion comprises, at least one engaging block adapted to be engaged with the engaging slot through elastic deformation of the at least one elastic arm.

16. The speaker according to claim 11, wherein the at least one second connecting portion comprises at least one engaging slot, and the at least one first connecting portion comprises at least one engaging block adapted to move into the at least one engaging slot with rotation of the frame relative to the casing.

* * * * *